United States Patent [19]

Feng

[11] Patent Number: 5,052,263

[45] Date of Patent: Oct. 1, 1991

[54] DECORATION BOX WITH MUSIC AND COLORED FLASHING LIGHT BEAMS

[76] Inventor: Grace Feng, 8F1., No. 222, Fu Hsing N. Road, Taipei, Taiwan

[21] Appl. No.: 641,926

[22] Filed: Jan. 16, 1991

[51] Int. Cl.[5] ..... A63J 17/00; G10F 1/06

[52] U.S. Cl. ..... 84/464 R; 84/95.2

[58] Field of Search ..... 84/464 R, 95.1, 95.2, 84/96, 94.2, 97, 98, 99, 464 A; 350/4.1; 353/1; 272/8 P

[56] References Cited

U.S. PATENT DOCUMENTS 4,858,079 8/1989 Ohashi ..... 84/95.2 X 4,952,004 8/1990 Baird et al. ..... 350/4.1

*Primary Examiner*—Russel L. Adams, Jr.

*Assistant Examiner*—Jae N. Noh

*Attorney, Agent, or Firm*—Cushman, Darby & Cushman

[57] ABSTRACT

Disclosed is a decoration box which sends out music and colored flashing light beams simultaneously when played. The music comes from a conventional cylinder-type music generator, and the colored flashing light beams result from a circular dish having a plurality of openings with colored translucent sheets affixed thereto.

1 Claim, 3 Drawing Sheets

DECORATION BOX WITH MUSIC AND COLORED FLASHING LIGHT BEAMS

BACKGROUND OF THE INVENTION

The present invention is related to a decoration box, and more particularly, to a decoration box which sends out music and colored flashing light beams simultaneously.

SUMMARY OF THE INVENTION

It is an object of the present invention to integrate music with colored flashing light beams in a decoration box for more amusing and pleasing effects.

In accordance with the object, the present invention provides a box which comprises a music generator; a circular dish having a plurality of openings; a plurality of different colored translucent members affixed to the openings of the dish, for allowing a white light to pass therethrough and producing colored light beams; at least one lamp; and a decorative member mounted on the dish. The center of the dish is fixed to the winding shaft of the music generator. In this manner, the transparent member can be rotated manually for winding the coil spring of the music generator. The dish will be driven to rotate backward by the energy released from the restoring of the coil spring. Music and colored flashing light beams are thus generated simultaneously.

A more detailed understanding of the present invention can be achieved by a reading of the following detailed description in conjunction with the accompanying drawings.

DETAILED DESCRIPTION OF THE PREFERRED EMBODIMENTS

Referring now to FIGS. 1–5, FIG. 1 shows the outer appearance of the preferred embodiment of the present invention, which includes a glass ball 11 and a base 12.

Figure 2:
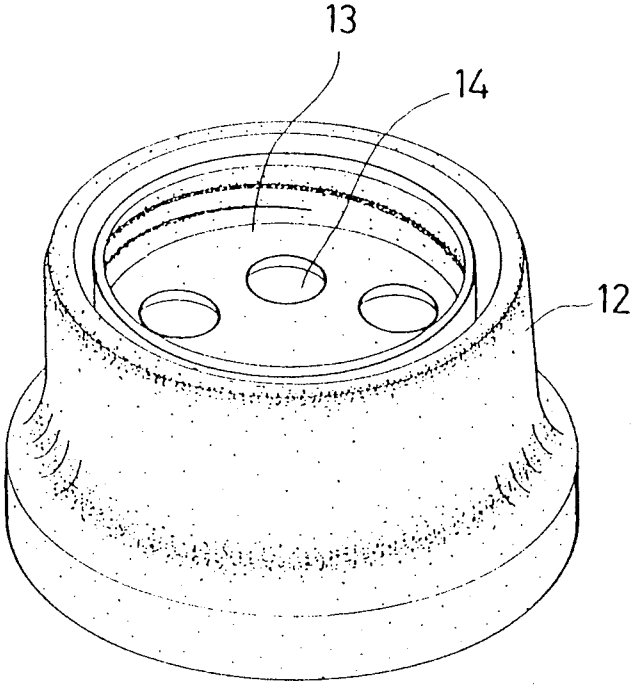
FIG. 2 is a perspective view of the same preferred embodiment with the glass ball removed to show the circular disk therebehind.
Figure 1:
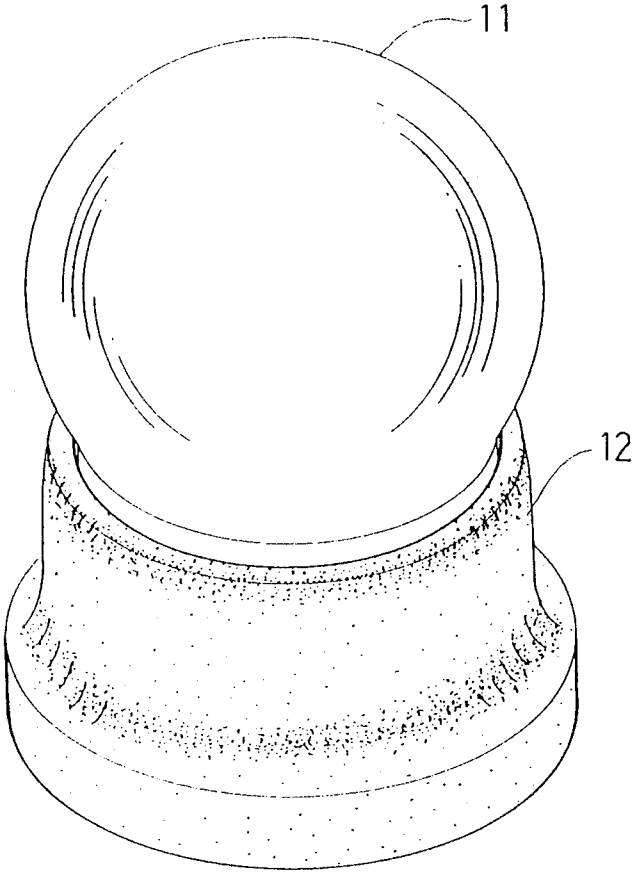
FIG. 1 is a perspective view of a preferred embodiment of the present invention.
Figure 3:
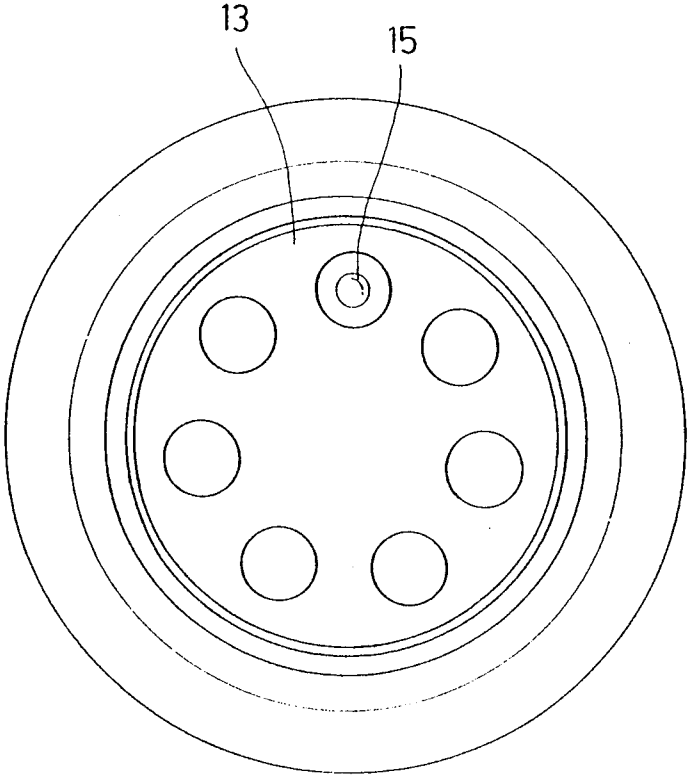
FIG. 3 is a plan view of the illustration in FIG. 2.

In FIG. 2 and 3, the glass ball 11 is removed to show a circular disk 13 having seven circular openings 14 thereon, and a lamp 15 placed underneath the circular disk 13. Glass sheets with different colors are affixed to each of the openings 14 so that a colored light beam will be produced therefrom when a white light passes through the opening 14. The openings 14 are formed in such a way that, when the circular disk 13 rotates, each will go over the lamp 15 one after the other.

In another preferred embodiment, two or more lamps may be utilized for a mixed colorful light effect.

Figure 4:
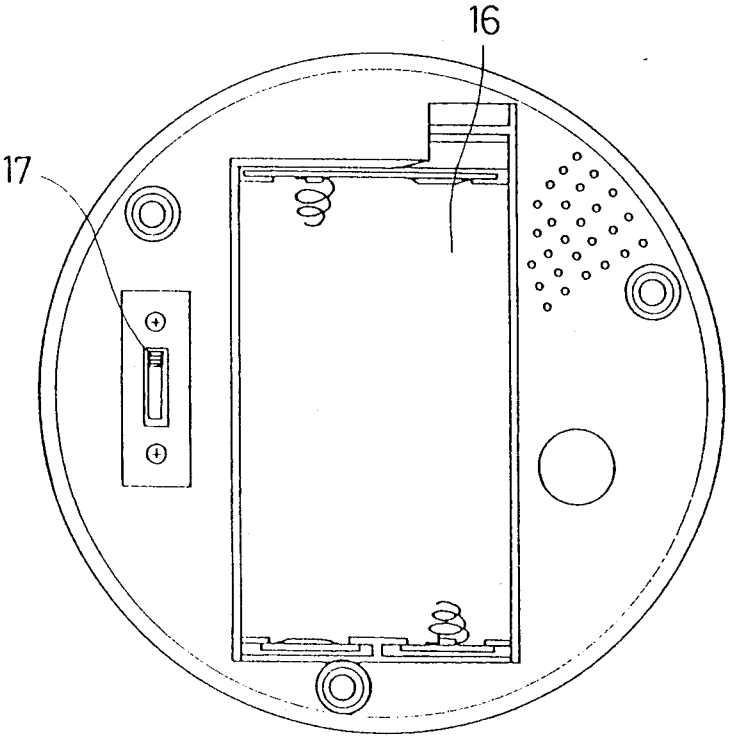
FIG. 4 is a rear plan view of the preferred embodiment showing the battery compartment and power switch.

Referring now to FIG. 4, the illustration shows the bottom part of the preferred embodiment, wherein a battery compartment is indicated by a numeral 16 and a switch indicated by a numeral 17. The battery compartment 16 is used for placing the batteries to supply electricity to the lamp 15. The switch 17 is used to turn the electricity off when the colored flashing light beams are not desired.

Figure 5:
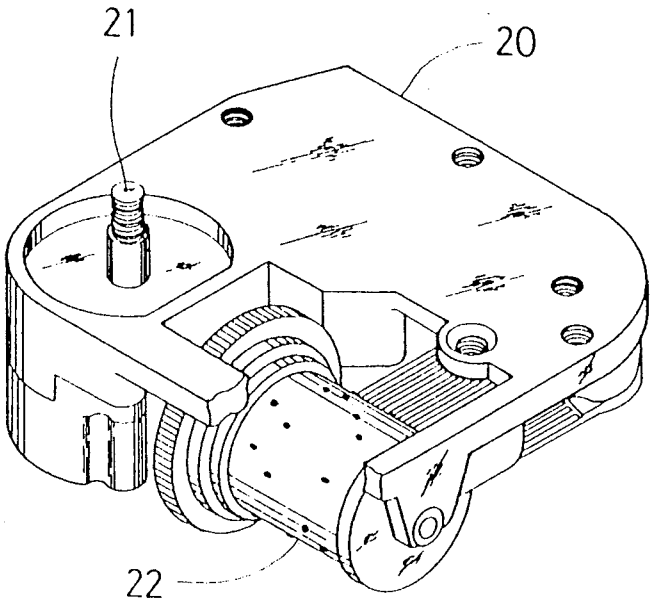
FIG. 5 is a perspective view of the cylinder-type music generator included in the decoration box of FIG. 1.

Referring further to FIG. 5, this illustration shows a cylinder-type music generator 20. The music generator 20 utilized in this embodiment is a Japanese patented invention. It is employed in the present invention for generating the music. In the figure, a numeral 21 indicates a winding shaft of the music generator 20 and a numeral 22 indicates the cylinder-type music generating means. The cylinder-type music generating means 22 is powered by a coil spring (not shown) which can be wound by revolving the winding shaft 21.

Figure 6:
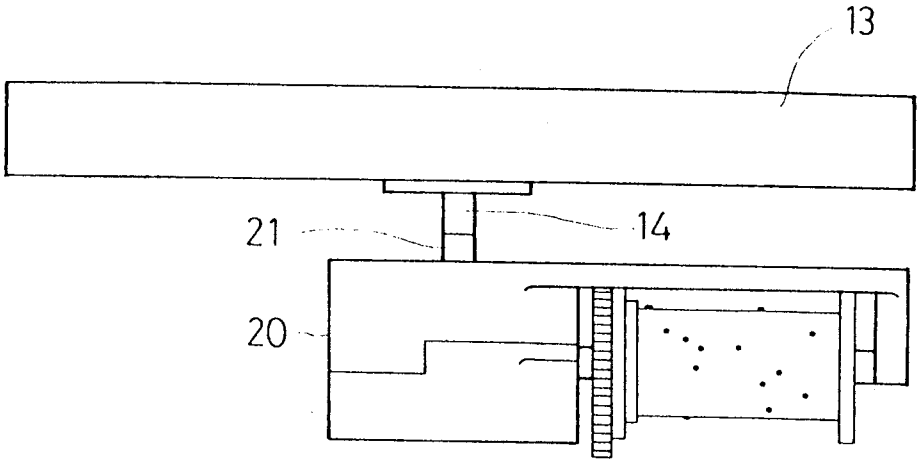
FIG. 6 is a front view of FIG. 5 with the circular disk being fixed onto the music generator.

The present invention is characterized in that it utilizes the energy from the restoring of the wound coil spring (not shown) in the music generator 20 for rotating the circular disk 13. The realization is shown in FIG. 6, in which the circular disk 13 is fixed by a fastening means 14 to the winding shaft 21 of the music generator 20.

After the understanding of each part of the preferred embodiment of the present invention, the working principles of the present invention is described hereafter.

The coil spring of the music generator 20 can be wound by manually rotating the glass ball 11. When the coil spring is releasing its energy, it drives both the cylinder and the winding shaft 21 in the backward direction. The rotating of the cylinder generates music, while that of the winding shaft 21 spins the circular disk 13 and the glass ball 11 thereon. The spinning of the circular disk 13 brings each openings with colored glass sheet affixed thereon go over the lamp 15 one after the other. In this manner, a colored flashing light beams are generated simultaneously with the accompanying music. The lamp 15 can be switched off by turn the switch 17 to the OFF position when only music is desired.

The result of the present invention is obvious that there is provided an amusing and pleasing effect when the box is played and sends out delightful music along with the varied colored flashing light beams.

While the invention has been described by way of example and in terms of a preferred embodiment, it is to be understood that the invention need not be limited to the disclosed embodiment. On the contrary, it is intended to cover various modifications and similar arrangements included within the spirit and scope of the appended claims, the scope of which should be accorded the broadest interpretation so as to encompass all such modifications and similar structures.

What is claimed is:

1. A decoration box for sending out music and colored flashing light beams simultaneously, comprising:

a music generator having music generating means, and a winding shaft for winding a coil spring within said music generator;

a dish, which is connected to said winding shaft, having a plurality of openings;

a plurality of colored translucent members, each of which is affixed to said opening of said dish, for allowing a white light to pass therethrough and producing a colored light beam;

at least one lamp, placed under said dish, over which each said opening will pass when rotating said dish; and a decorative member, through which lights will pass, mounting on said dish for manually winding said coil spring and for decorative purpose.

* * * * *